US009662708B2

(12) United States Patent
Schmitt et al.

(10) Patent No.: US 9,662,708 B2
(45) Date of Patent: May 30, 2017

(54) METHOD FOR PRODUCING A GREEN COMPACT

(75) Inventors: Rainer Schmitt, Wachtberg (DE); Antonio Casellas, Siegburg (DE)

(73) Assignee: GKN Sinter Metals Holding GmbH, Radevormwald (DE)

( * ) Notice: Subject to any disclaimer, the term of this patent is extended or adjusted under 35 U.S.C. 154(b) by 892 days.

(21) Appl. No.: 13/427,198

(22) Filed: Mar. 22, 2012

(65) Prior Publication Data

US 2012/0216654 A1 Aug. 30, 2012

Related U.S. Application Data

(63) Continuation of application No. PCT/EP2010/005595, filed on Sep. 13, 2010.

(30) Foreign Application Priority Data

Sep. 23, 2009 (DE) ..... 10 2009 042 598

(51) Int. Cl.
*B22F 3/03* (2006.01)
*B22F 7/06* (2006.01)
*B30B 11/02* (2006.01)

(52) U.S. Cl.
CPC ..... *B22F 3/03* (2013.01); *B22F 7/062* (2013.01); *B30B 11/02* (2013.01)

(58) Field of Classification Search
CPC ..... B32B 15/02; B22F 1/00; B22F 3/02
See application file for complete search history.

(56) References Cited

U.S. PATENT DOCUMENTS

| | | | | |
|---|---|---|---|---|
| 4,946,634 | A * | 8/1990 | Shaner | 264/40.5 |
| 5,698,149 | A | 12/1997 | Hinzmann et al. | |
| 2004/0025323 | A1* | 2/2004 | Asaka et al. | 29/598 |
| 2007/0028446 | A1 | 2/2007 | Arit et al. | |
| 2012/0107434 | A1 | 5/2012 | Murasugi et al. | |

FOREIGN PATENT DOCUMENTS

| | | | |
|---|---|---|---|
| JP | S47-27813 | U | 11/1972 |
| JP | S48-8607 | U | 1/1973 |
| JP | S48-11209 | A | 2/1973 |
| JP | S52-2817 | A | 1/1977 |
| JP | S53-39709 | A | 4/1978 |
| JP | S57-20717 | U | 2/1982 |
| JP | S59-93803 | A | 5/1984 |

(Continued)

OTHER PUBLICATIONS

The International Bureau of WIPO—Agnes Wittmann-Regis; Translation of International Preliminary Report on Patentability for corresponding International Application No. PCT/EP2010/005595; mailed May 24, 2012; 9 pages.

(Continued)

*Primary Examiner* — Rebecca Lee
(74) *Attorney, Agent, or Firm* — Quarles & Brady LLP

(57) ABSTRACT

The invention relates to a method for producing a green compact, said green compact comprising at least two partial green compacts, each partial green compact being compacted and joined from at least one powdery material in one working cycle. Particularly, two, three, four or more than four partial green compacts can be compacted and joined in one working cycle.

8 Claims, 2 Drawing Sheets

(56) References Cited

FOREIGN PATENT DOCUMENTS

| | | | | | |
|---|---|---|---|---|---|
| JP | H04-74807 | A | | 3/1992 | |
| JP | 08134509 | A | * | 5/1996 | ..... B22F 7/02 |
| JP | 8134509 | A | | 5/1996 | |
| JP | H11264002 | A | | 9/1999 | |
| JP | 2000144212 | A | | 5/2000 | |
| JP | 2000290707 | A | | 10/2000 | |
| JP | 2001105193 | A | | 4/2001 | |
| JP | 2001232499 | A | | 8/2001 | |
| JP | 2007061833 | A | | 3/2007 | |
| JP | 2012096240 | A | | 5/2012 | |

OTHER PUBLICATIONS

European Patent Office—Gilles Forestier; International Search Report for corresponding International Application No. PCT/EP2010/005595; mailed Apr. 2, 2011; 2 pages.
Japanese Patent Office, Office Action for corresponding Japanese Application No. 2012-530150, dated Jul. 7, 2016, 11 pages.

* cited by examiner

METHOD FOR PRODUCING A GREEN COMPACT

CROSS-REFERENCE TO RELATED APPLICATIONS

This application is a continuation application of PCT application serial number PCT/EP2010/005595 entitled "Method for Producing a Green Compact" filed on Sep. 13, 2010 which claims priority to German patent application number 10 2009 042 598.5 filed on Sep. 23, 2009. The contents of both of these applications are incorporated by reference as if set forth in their entirety herein.

BACKGROUND

The disclosure relates to a method for producing a green compact and, in particular, to a green compact comprising at least two partial green compacts.

EP 399 630 B1 discloses a method for producing a green compact, wherein powder metal material is pre-compacted to a first green compact, and wherein a second, separately pre-compacted green compact or solid part is then inserted in a cavity of the first green compact in the press. The composite green compact then undergoes final compaction.

SUMMARY

The object of the invention is that of providing an improved method for producing a green compact.

The object of the invention is achieved with a method, a tool, a use, a computer program product, a control device, and a green compact such as those that are found in the claims. However, the individual features in the claims are not limited to these, but they can be combined with other features (particularly those emerging from the description) into other embodiments.

A method for producing a green compact is proposed, said green compact comprising at least two partial green compacts, wherein the partial green compacts are each compacted and joined from a powdery material in one working cycle. Particularly two, three, four, or more than four partial green compacts can be compacted and joined, or compacted, consolidated and joined in one working cycle.

The proposed method is considerably faster than separately compacting each partial green compact to be joined, and then combining the partial green compacts. In a first embodiment, provision is made for compacting the partial green compacts in the same tool. Particularly, at least one partial green compact can be pre-compacted and then re-compacted or finally compacted before or after the joining. In another embodiment, the preferable provision is made that the joined green compact is re-compacted or finally compacted in the same tool. The additional preferred provision is made that particularly all partial green compacts to be joined are compacted before or during the joining such that re-compaction after the joining is not necessary.

In another embodiment, the provision is made that the powdery material is fed into at least one filling space of a tool in a first step and that the powdery material is separated into at least two partial quantities in a second step. In another embodiment, it is proposed that a first partial quantity of the powdery material be fed into a first working space and that a second partial quantity be fed into a second working space. Working space is understood to mean particularly cavities in a press tool that can be filled with a powder and in which a pressing process or a compaction of the powder can be carried out. The working spaces are preferably delimited by at least one punch. In an improvement, the working space is delimited by at least two punches and/or a die. The working space can be movably configured such that, for example, a process for compacting the powdery material or the partial quantity arranged in the working space can be carried out during a movement of the entire working space. In one embodiment, provision is also made for the movement of the working space and the partial quantity of the powdery material arranged therein without the compaction thereof. The filling space is an area that is filled with the powdery material. Particularly, it can comprise at least one working space. Particular provision is made of one separate filling space for at least two partial quantities, respectively. In one embodiment the provision is also made that a first filling space is filled with a first partial quantity of the powdery material and a second filling space with a second quantity of the powdery material. In another embodiment, the provision is made that exactly one filling space is filled with the powdery material and the latter is separated into at least two partial quantities using, for example, at least one punch, preferably a top punch and/or a bottom punch. Particular preference is given to transferring the partial quantities to separate working spaces of the same tool using the punch.

The method also offers an advantage if the partial green compacts are first compacted separately, then consolidated, and finally joined in one tool. The separated partial quantities of the powdery material in the tool are thus compacted to two separate partial green compacts and consolidated in the tool in a subsequent process step. Separate compaction can mean that the partial quantities of the powdery material are spaced apart from one another in the tool such that two separate working spaces distanced from one another are created in the tool in which are produced separate green compacts, which are then called partial green compacts. During the compacting it is also possible for the punches of the adjacent working space to form a working space for the respective other pellet or partial green compact. A punch arranged in the center of the tool can form a hollow space in a first working space for a first partial green compact, whereas the outer punches for the first partial green compact create an outer working space for a second partial green compact that is formed using the center punch. The embodiment is not limited herein to compacting both of the partial green compacts separately; in fact, it is also possible first to compact a partial green compact in a first separate working space and then to transfer this partial green compact to the second working space for the second partial green compact. During the compaction of the second partial green compact, the first partial green compact is held in the working space thereof so that the first partial green compact is joined directly with the second partial green compact as the latter is being formed. The consolidation of the first and second green compacts is thus shifted to a working phase of the tool in which the second partial green compact is being compacted.

Punch is the generic term for bottom punch and top punch. Particularly, a punch can be used for pressing powdery material (i.e., compacting); and partial green compacts can be joined as well.

In another embodiment, the provision is made that in and/or after a transfer of a partial quantity using a punch, a joining space is kept clear by said punch. Particularly, this joining space is at least partially delimited by another partial quantity of the powdery material. Joining space is understood to mean the area inside a partial quantity or a partial compact in which another partial compact is joined.

In another variant, the provision is made that the partial quantities of the powdery material are compacted to a first partial green compact in the first working space and to a second partial green compact in the second working space. One variant also provides for joining at least one first partial green compact with a second partial green compact before or during the demolding from the tool. Preference is given to joining the partial green compacts and then demolding them in a subsequent step. It is also possible for the joining of the partial green compacts to occur simultaneously with the demolding of the green compact, wherein, for example, the second partial green compact is moved in a discharge direction out of the tool, and wherein the latter is transferred into the first partial green compact, preferably into the joining space of the same. When the joining is complete, particularly, the provision is made that the joined green compact is moved in the discharge direction without the punch or punches that joined the second partial green compact into the first green compact coming to a standstill.

In another embodiment, provision is made for compacting the second partial quantity to a second partial green compact and for transferring the second partial green compact to the first working space. In an embodiment, the provision is also made that the first partial quantity is compacted in the first working space, after the second partial green compact has been transferred to the first working space. Furthermore, the first partial quantity can also be compacted in the first working space while the second partial green compact is being transferred into the first working space.

Due to factors such as inhomogeneities in density or axial and radial stresses in the tool, sintered components are at risk of cracking along cross-sectional transitions during the actual compacting as well as the demolding and subsequent handling. The cracking risk along cross-sectional transitions, for example, due to stresses generated in the green compact during the pressing process, are avoided by the proposed method since the at least two green compacts are compacted independently of one another without detrimental influences along cross-sectional transitions and are then joined in one working cycle. A particularly preferred accuracy of fit is achieved between the partial green compacts being joined by keeping the joining space clear by means of at least one punch. If after demolding and, where applicable, after other processing steps, the green compact is then sintered, a fusion at the contact surfaces of the partial green compacts is brought about by the high accuracy of fit. Preference is given to joining the partial green compacts by press fitting.

In another embodiment the provision is made that the first partial quantity and the second partial quantity contain different alloys. Moreover, in one embodiment, the provision is also made that the first partial quantity and the second partial quantity contain the same alloy. For joining two partial green compacts using the proposed method, it is not necessary to provide different alloys exhibiting different shrinkage characteristics. In fact, the partial green compacts can each contain the same alloy or an alloy that exhibits essentially the same or exactly the same shrinkage characteristics. With the proposed method, it is also no longer necessary to achieve sufficient bonding of the partial green compacts, e.g., a press fitting by sintering, particularly, different materials or materials with different shrinkage characteristics, as the bonding of the partial green compacts is already sufficient for a secure fixation after the pressing process. Particularly the mechanical clamping of the partial green compacts after demolding is sufficient for transport to the sintering oven; the partial green compacts preferably exhibit a contact pressure, in at least one subarea of the contact surfaces, of 0.1 $N/mm^2$ to 100 $N/mm^2$ more preferably 1 $N/mm^2$ to 50 $N/mm^2$, and particularly preferably 2 $N/mm^2$ to 30 $N/mm^2$. After the sintering, particularly with fusion along the grain boundaries between the partial green compacts, said partial green compacts have a mutual bond strength nearly equal to that of the remaining structure, particularly a bond strength of 70% to 99% of the remaining structure, more preferably 90% to 100% of the remaining structure. In the sintering of partial green compacts, preference is given to at least partial fusion occurring at the interfaces of the partial green compacts.

In a preferred embodiment of the method, a filling space of a tool is filled with the powdery material, said tool having at least a first bottom punch, a second bottom punch, a first top punch, and a second top punch, wherein a first working space is delimited at least by the first top punch and the first bottom punch and is preferably part of the filling space. In a subsequent step, the second bottom punch and the second top punch transfer a partial quantity of the powdery material to a second working space, said second working space being delimited at least by the second top punch and the second bottom punch and preferably arranged outside of the first working space. The partial quantities of the powdery material are compacted at least in the first working space into a first partial green compact and in the second working space into a second partial green compact. The second partial green compact is moved into the first working space before, during, or after the compaction of the first partial green compact in order to join the partial green compacts. Further preference is given to the working spaces having no contact surfaces before and/or during the compaction of at least one of the partial green compacts such that the compaction of the powdery material occurs at least partially and/or separately in at least one working space.

Another concept of the invention is a tool for a press for compacting and joining at least two partial green compacts, said tool having at least a first and a second top punch and a first and a second bottom punch, wherein at least the first bottom punch and the first top punch can be moved independently of the second bottom punch and the second top punch. In one embodiment, the preferable provision is made that a first working space can be created at least by the first top punch and the first bottom punch, and a second working space can be created at least by the second top punch and the second bottom punch. In an improvement, the provision is made that the second working space is also at least partially delimited or at least partially defined by the first top punch or the first bottom punch. In a variant, the further provision is made that the first working space and/or the second working space is/are at least partially delimited or partially defined by at least one die. Also, in one embodiment, the provision is made that at least one third punch can at least partially delimit or define the first and/or the second working space.

In one variant, the provision is made that a joining space is reservable in the first working space using at least the second top punch or the second bottom punch, and into which space the second partial green compact can be transferred. The punch that reserves the joining space has, in particular, a slightly smaller diameter than the partial green compact being joined in the joining space. The difference or the excess corresponds to the punch play between the first bottom punch and the second top punch. Punch plays are in the range of around 0.005 to 0.025 mm. The force for joining the partial green compacts is proportional to the contact surfaces between the partial green compacts being joined;

i.e., the larger the contact surfaces, the greater the force that is applied to the partial green compact. The partial compact is compacted in the joining space, particularly with a force of around 1 $N/mm^2$ to 100 $N/mm^2$, preferably between around 10 $N/mm^2$ and 50 $N/mm^2$.

In another concept of the invention, provision is made for the use of one of the tools described above for a method as described above.

In another concept of the invention, provision is made for a computer program product for a press for compacting and joining at least two partial green compacts in one working cycle, said press having at least one first top punch, one first bottom punch, one second top punch and one second bottom punch, wherein the press is controlled such that, after the filling of a working space with at least one powdery material, at least one second bottom punch and a second top punch separate a second partial quantity of the powdery material from a first partial quantity. Preference is given to controlling the press such that a first partial quantity of the powdery material is fed into a first working space and a second partial quantity is fed into a second working space. Particularly, the control is effected such that a first punch serves at least partially as a die of the second working space; i.e., the second working space is arranged at least partially inside of the first top punch or the first bottom punch.

Particularly, the press is controlled such that a first partial green compact is compacted in a first working space and a second partial green compact is compacted in a second working space. The computer program product preferably controls the press such that the first partial green compact and the second partial green compact are joined prior to demolding.

A computer program product offers an advantage if said computer program product controls the press such that the separate partial quantities are compacted into partial green compacts, then consolidated and lastly joined. Using the computer program product it is possible to control first a separate compacting of the partial quantities of the powdery product in separate working spaces distanced from each other, after which step consolidation occurs; i.e., the partial green compacts are pushed on top of one another or into one another. The computer program product then controls the joining such that both of the partial green compacts are consolidated and joined, with or without after-compacting. A control using the computer product is also possible to the effect that a first partial green compact is formed in a first working step in a first working space, that the formed first partial green compact is then moved to the working space of the second partial green compact in a subsequent second working step and that, lastly, the second partial green compact is compacted in a third working step. The joined partial green compacts are then ejected by opening the tool and removing or ejecting said joined partial green compacts for further processing.

In one embodiment of the computer program product, the provision is made that said computer program product controls the press using path control or path regulation. Preference is given to a closed control circuit for controlling the press. In one embodiment, the additional provision is made that the computer program product controls the press such that the punches apply a pre-specified force to the powdery material or execute pre-specified work on the powdery material. Preference is given to a combination of path and force control. In one embodiment, additional provision is made of a closed control circuit for controlling the press.

Another concept of the invention is a control means for a press, particularly with a tool as described above, wherein the control device contains a computer program product as described above. Particularly, the control device has a closed control circuit for the path and/or force control of the press.

Another concept of the invention relates to a green compact having at least two partial green compacts, which are joined by a method as described above. Preference is given to joining the partial green compacts with a perfect fit. Further preference is given to an interference or press fitting between the partial green compacts. In one embodiment, the green compact can be joined from two, three, four or more than four partial green compacts. In one embodiment the provision is also made that the green compact contains one or more than one alloy. Particularly, all partial green compacts contain the same alloy. In one embodiment, the additional provision is made that at least two partial green compacts contain a different alloy.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

BRIEF DESCRIPTION OF THE DRAWINGS

Further advantageous embodiments will become clear from the following drawings. The improvements illustrated therein, however, are not to be construed as limiting; in fact, the features described therein can be combined with one another and with the features described above into other configurations. Furthermore, it should be noted that the reference signs given in the description of the figures do not limit the scope of protection of the present invention but only refer to the illustrative embodiments shown in the figures. In the following the same parts or parts with the same function have the same reference signs. In the drawings.

DETAILED DESCRIPTION OF THE PREFERRED EMBODIMENTS

Figure 1:
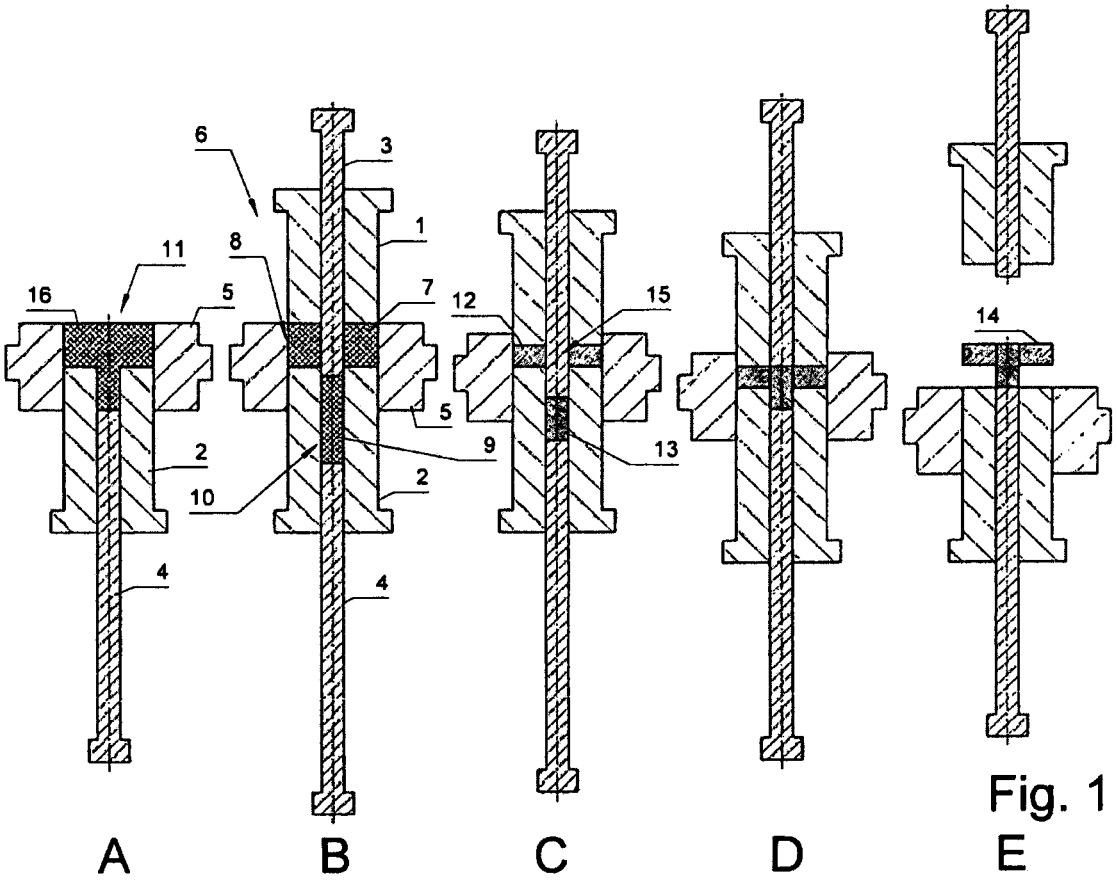
FIG. 1 is an outlined process flow of a compacting and joining in one working cycle.

FIG. 1 shows a process flow A to E of a compacting and joining of two partial green compacts in one working cycle. At least one first top punch 1, one first bottom punch 2, one second top punch 3, one second bottom punch 4 and a die 5 constitute a tool 6. The tool 6 is opened for filling with a powdery material 11 and, as shown in step A, the first bottom punch 2 and the second bottom punch 4 are moved such that a filling space 16 forms. The filling space 16 is filled with the powdery material.

In step B it can be discerned that the tool is being closed and that, particularly, a first top punch 1 and a second top punch 3 cap the filling space delimiting it toward the top. It can also be seen in step B that the second top punch 3 and the second bottom punch 4 are moved such that a first partial quantity 7 of the powdery material 11 is separated from a second partial quantity 9 of the powdery material 11. Particularly the second partial quality 9 is transferred into a second working space 10, wherein a first partial quantity remains in a first working space 8. The filling space 16, particularly, comprises the first working space 8.

In step C, the punches move together. It can be discerned that the first top punch 1 and the first bottom punch 2 compact the first partial quantity 7 in the first working space 8 into a first partial green compact 12. Additionally, the second partial quantity 9 is compacted in the second working space 10 into a second partial green compact 13 using the second top punch 3 and the second bottom punch 4. In this embodiment, a joining space 15 is kept clear inside the first working space 8 using the second top punch 3. Particularly, the joining space 15 is at least partially delimited by the first partial green compact 12 after the pressing process.

Step D shows the consolidation; i.e., how the second top punch 3 and the second bottom punch 4 move the second partial green compact 13 into the joining space 15 and thus join the first partial green compact 12 and the second partial green compact 13. In another embodiment the first partial green compact 12 is moved using the first top punch 1 and the first bottom punch 2 such that the partial green compacts 12, 13 are joined. In another embodiment, the partial green compacts 12, 13 are then after-compacted following the joining using the punches 1, 2, 3, 4.

In step E the finished green compact 14 is demolded from the tool 6. In one embodiment, the green compact 14 is calibrated and/or undergoes a milling process after demolding. Preference is given to sintering the green compact 14 after demolding.

Figure 2:
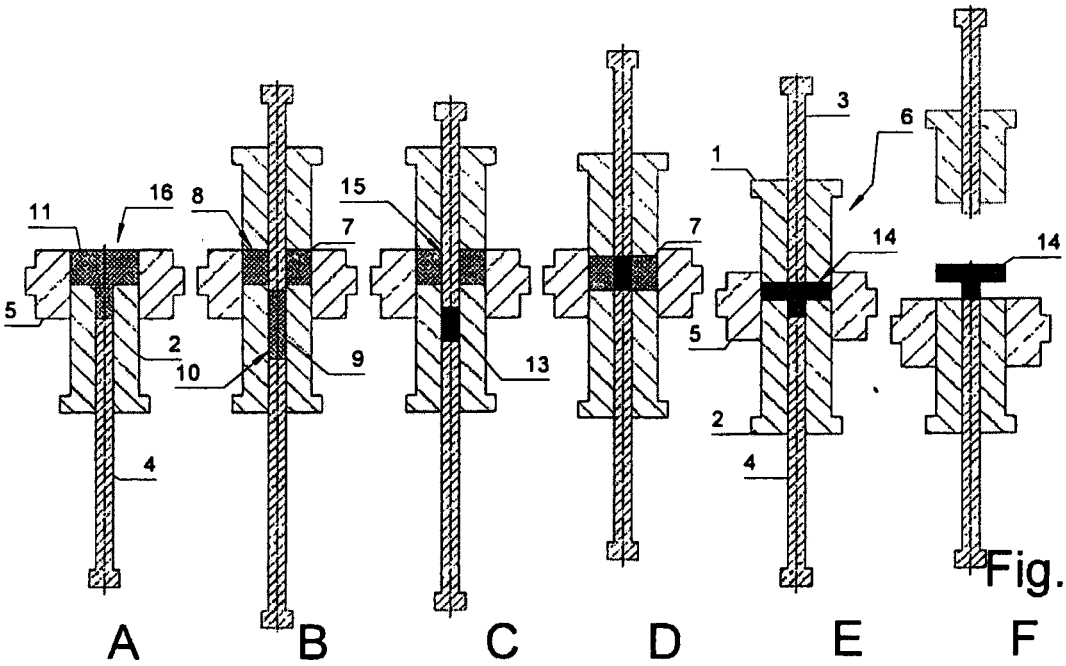
FIG. 2 is an alternative process flow of a compacting and joining in one working cycle.

FIG. 2 shows an alternative embodiment of the compacting and joining of partial green compacts. In step A, the filling space 16 is filled with the powdery material 11. In this embodiment the first bottom punch 2, the second bottom punch 4 and the die 5 constitute the filling space 16.

In step B, a second partial quantity 9 is moved into a second working space 10 while a first partial quantity 7 remains in the first working space 8, similarly to the process step shown in step B of FIG. 1.

In step C, it can be discerned that the second partial quantity 9 is compacted into a second partial green compact 13. The first green compact 7, however, is not compacted at all or only slightly compacted. Particularly, the compacting process starts during or after a compaction of the second partial green compact 13, said process still not having been completed after a compaction of the second partial green compact 13.

In step D, the second partial green compact 13 is transferred, conveyed or moved to the joining space 15 kept clear by the second top punch 3. The process of compacting the first partial quantity 7 into the first partial green compact 12 starts no later than after the second partial green compact 13 is inserted in the joining room 15.

Step E shows the finally joined and compacted green compact 14 in the tool 6. In the process of compacting the first partial green compact 12, the second partial green compact 13 in the illustrative embodiment shown is moved relative to the die 5. Particularly the first top punch 1 and the second top punch 3 are moved synchronously; preferably, the second bottom punch is also moved relatively.

The final green compact 14 is demolded in step F.

Figure 3:
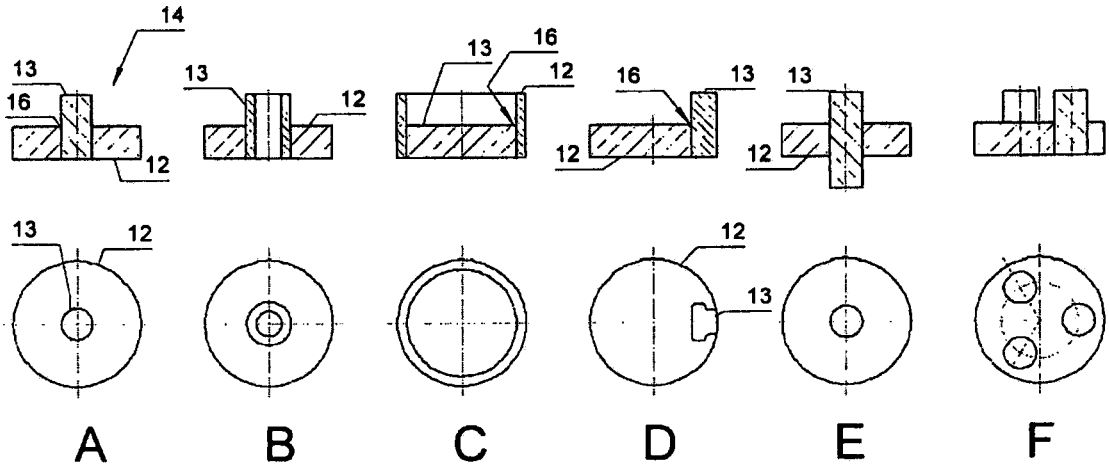
FIG. 3 is a selection of configurations of joined partial green compacts.

FIG. 3 shows a partial selection of configurations of the green compact 14. The geometric shapes shown here have been selected solely by way of an example; different shapes not shown here are also possible. It is also intended for the configurations shown here to be combined with one another and/or with other shapes not shown here to constitute new configurations.

Configuration A shows a green compact 14 having a first partial green compact 12 and a second partial green compact 13. The second partial green compact 13 projects beyond the first partial green compact 12 so that the green compact 14 has across-sectional variation 16, which is formed particularly medially.

Configuration B shows a green compact 14 in which the second partial green compact 13 is configured as a tube or hollow part. It can also be discerned in configuration C that the first partial green compact 12 is configured as a hollow part and, particularly, projects beyond the second partial green compact 13. The cross-sectional variation 16 is laterally formed here.

Configuration D shows another variant of a lateral cross-sectional variation 16. The second partial green compact 13 projecting beyond the first partial green compact 12 is only partially enclosed in a cross-section by the first partial green compact 12.

Configuration E shows that the second partial green compact 13 projects beyond both sides of the first green compact 12. In configuration F, it can also be discerned that more than two partial green compacts can be joined. Particularly four partial green compacts are joined in configuration F. In other configurations, however, provision is made for joining three, five or more than five partial green compacts.

Figure 4:
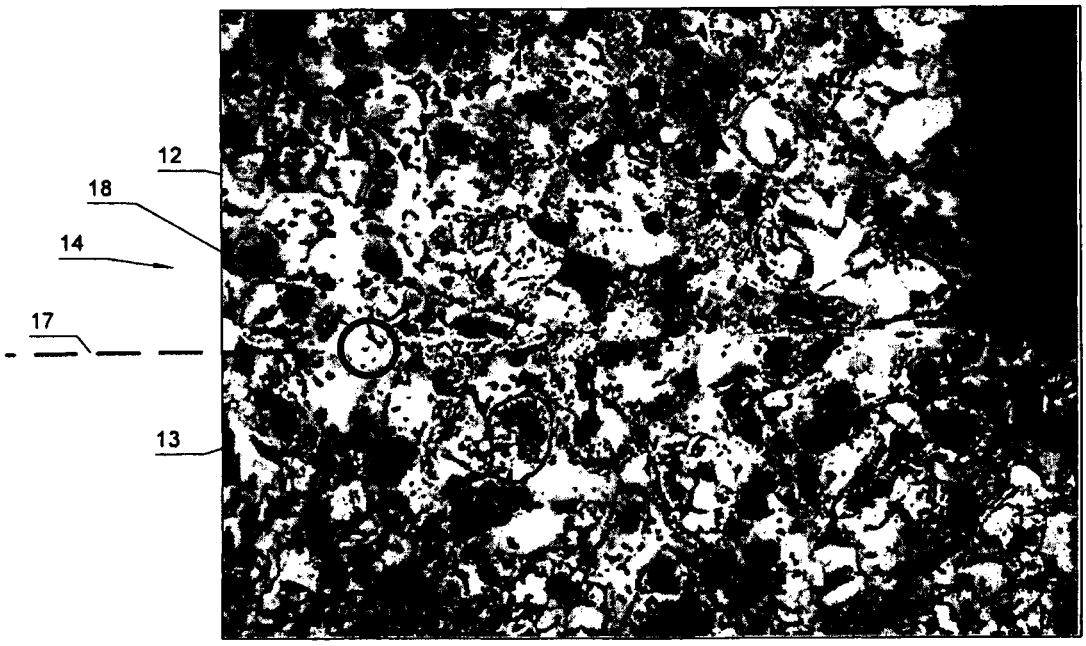
FIG. 4 is a microsection of a sintered green compact consisting of two partial green compacts.

FIG. 4 shows an etched microsection of a joined and sintered green compact 14 composed of a first partial green compact 12 and a second green compact 13. An interface 17, which has been extended by a dashed line for purposes of clarity, can be discerned between the partial green compacts 12, 13. However, it can also be seen in FIG. 4 that a fusion 18 across grain boundaries has occurred.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A method for producing a green compact having at least two partial green compacts, the method comprising compacting the partial green compacts from a powdery material of an alloy and joining the partial green compacts, wherein the compacting and joining steps occur during one working cycle of a press and the joining step occurs under press fit, wherein the powdery material is fed into one filling space of a tool in a first step and the powdery material is separated into at least two partial quantities of the same alloy in a second step and thereby a first partial quantity of the powdery material is fed into a first working space and a second partial quantity of the powdery material is fed into a second working space, wherein the partial quantities of the powdery material are compacted into a first partial green compact in the first working space and into a second partial green compact in the second working space, and wherein the partial green compacts are moved together under interference to form a press fit between the partial green compacts thereby joining the compacts together.

2. The method as in claim 1, wherein the partial green compacts are compacted in the same tool.

3. The method as in claim 1, wherein at least one first partial green compact is joined with a second partial green compact before or during demolding from a tool.

4. The method as in claim 1, further comprising compacting a first partial quantity and a second partial quantity of the powdery material into a first partial green compact in a first working space and into a second partial green compact in a second working space, respectively, and transferring the second partial green compact to the first working space.

5. The method as in claim 4, wherein the first partial quantity is compacted in the first working space after the second partial green compact has been transferred to the first working space.

6. The method as in claim 4, wherein the first partial quantity is compacted in the first working space while the second partial green compact is being transferred to the first working space.

7. The method as in claim 1, wherein a filling space of a tool is filled with the powdery material, said tool having at least one first bottom punch, one second bottom punch, one first top punch and one second top punch, wherein a first partial quantity of the powdery material is fed into a first working space, wherein said first working space is delimited at least by the first top punch and the first bottom punch, and wherein the second bottom punch and the second top punch transfer a partial quantity of the powdery material into a second working space, wherein said second working space is delimited at least by the second top punch and the second bottom punch, wherein the partial quantities of the powdery material are at least compacted to a first partial green compact in the first working space and to a second green compact in the second working space, and wherein the second green compact is moved into the first working space before, during or after the compaction of the first partial green compact in the first working space in order to join said partial green compacts.

8. A method for producing a green compact from at least two partial green compacts, the method comprising:

feeding a powdery material into a single filling space of a tool;

separating the powdery material in the single filling space of the tool into at least two partial quantities including a first partial quantity in a first working space and a second partial quantity in a second working space, the first partial quantity having an alloyed composition that is the same as an alloyed composition of the second partial quantity;

compacting the powdery material into at least two partial green compacts including a first partial green compact and a second partial green compact, the first partial quantity of the powdery material being compacted into the first partial green compact in the first working space and the second partial quantity of the powdery material being compacted into the second partial green compact in the second working space; and joining the at least two partial green compacts by moving the first partial green compact and a second partial green compact together under interference to form a press fit between the first partial green compact and a second partial green compact;

wherein the compacting step and the joining step occur during one working cycle of a press.

* * * * *